US012693087B2

(12) United States Patent
Biegel

(10) Patent No.: US 12,693,087 B2
(45) Date of Patent: Jul. 28, 2026

(54) FIREARM TRIGGER MECHANISM INSTALLATION DEVICE AND METHOD

(71) Applicant: CMC Triggers Corp., Fort Worth, TX (US)

(72) Inventor: Jack Richard Biegel, Mansfield, TX (US)

(73) Assignee: CMC Triggers Corp., Fort Worth, TX (US)

( * ) Notice: Subject to any disclaimer, the term of this patent is extended or adjusted under 35 U.S.C. 154(b) by 0 days.

(21) Appl. No.: 19/276,362

(22) Filed: Jul. 22, 2025

(65) Prior Publication Data

US 2026/0071836 A1 Mar. 12, 2026

Related U.S. Application Data

(60) Provisional application No. 63/693,255, filed on Sep. 11, 2024.

(51) Int. Cl.
*F41A 11/00* (2006.01)
*F41A 19/45* (2006.01)

(52) U.S. Cl.
CPC ..... *F41A 11/00* (2013.01); *F41A 19/45* (2013.01)

(58) Field of Classification Search
USPC ..... 42/90, 108, 106
See application file for complete search history.

(56) References Cited

U.S. PATENT DOCUMENTS

| | | | |
|---|---|---|---|
| 7,162,824 | B1 | 1/2007 | McCormick |
| 7,293,385 | B2 | 11/2007 | McCormick |
| 8,069,606 | B1 | 12/2011 | Saur |
| 9,835,398 | B2 | 12/2017 | Biegel |
| 10,393,459 | B2 | 8/2019 | Tompkins |
| 2024/0200896 | A1 | 6/2024 | Moore |

FOREIGN PATENT DOCUMENTS

| | | | |
|---|---|---|---|
| CN | 113804051 | A | 12/2021 |
| TW | 409847 | U | 10/2000 |

*Primary Examiner* — Reginald S Tillman, Jr.
(74) *Attorney, Agent, or Firm* — Wood Herron & Evans LLP

(57) ABSTRACT

A tool for installing a fire control group in a lower receiver includes a pair of sides. The fire control group includes a set of trigger components and a set of hammer components. The first and second side each have an inner surface and an outer surface, and a recess is formed in each inner surface. When the first and second sides are assembled together, the inner surfaces of the sides contact each other and their recesses cooperate with each other to define a cavity within which the set of trigger components and the set of hammer components are at least partially arranged, the cavity having a bottom opening through which the fire control group may be withdrawn unobstructed by the first and second side. The tool also includes a flexible tie wrapped around the first and second sides for retaining the fire control group in a preloaded state.

19 Claims, 8 Drawing Sheets

FIREARM TRIGGER MECHANISM INSTALLATION DEVICE AND METHOD

RELATED APPLICATION

This application is a non-provisional application of provisional patent Application No. 63/693,255, filed Sep. 11, 2024, the entirety of which is incorporated herein by reference.

TECHNICAL FIELD

This invention relates to a device and method for installing a firearm fire control group (trigger mechanism) using a temporary, removable tool or jig to hold separate parts in place and in alignment, as a set, before and during installation.

BACKGROUND

The fire control mechanism or "group" in a semiautomatic firearm typically includes a trigger member, a trigger spring, a disconnector, a disconnector spring, a hammer, and a hammer spring, all of which are held in a receiver or fire control housing by at least two assembly pins that act as pivot axes for the trigger member and hammer. Often, the trigger and disconnector share a common pivot axis. In the most common designs, these are a combination of "loose components" that are assembled and installed by hand. The springs are bearing against parts and force has to be applied to overcome the spring tension to keep the parts in position for insertion of the trigger and hammer pins. Repeated practice and experience at installation builds skill over time, but for most consumers, it can be a challenging task.

Some time ago, modular trigger assemblies became commonly available. An example is shown in U.S. Pat. No. 7,162,824, issued Jan. 16, 2007, to Michael L. "Chip" McCormick. These modular assemblies include a housing that holds the component parts and can be assembled as a unit simply by inserting the hammer and trigger pins through openings in the receiver that align with the tubular axes of the unit. These are convenient, especially for consumer installation, and offer high quality single and double stage trigger models. But there may be a more limited selection of modular designs than there are for loose component designs, and some simply do not want a housing occupying space in the fire control pocket.

Thus, there is a need for "loose component" triggers with the installation convenience of an assembled modular housing trigger unit.

SUMMARY OF THE INVENTION

The present invention provides a device and method for easy installation of loose component fire control group parts into a firearm receiver.

According to one embodiment, a tool can be configured to temporarily hold the fire control group parts in a fixed relation to each other and aligned for insertion as a unit into a firearm receiver for installation by insertion of hammer and trigger pins.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
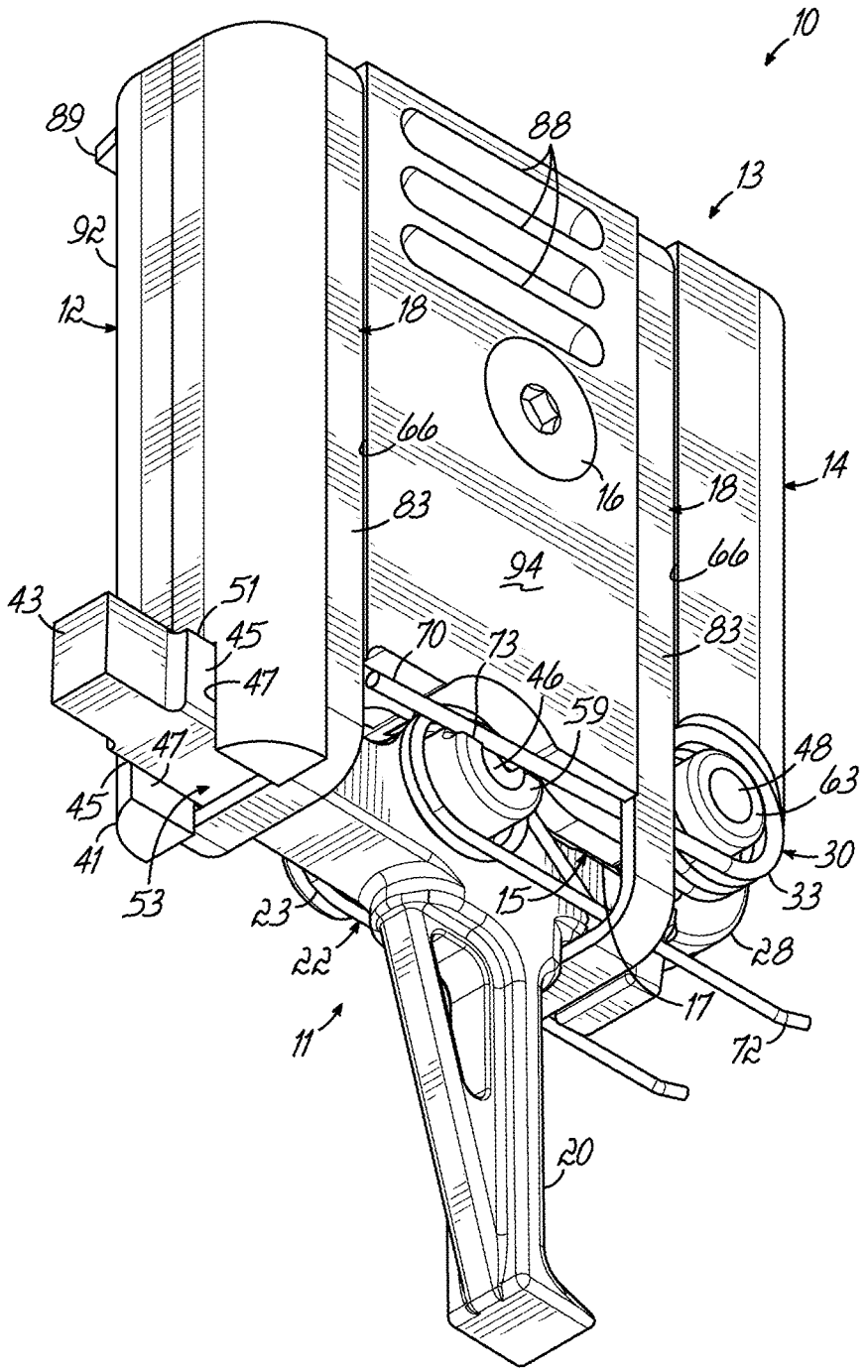
FIG. 1 is an isometric view of a trigger installation device according to an embodiment of the present invention with trigger component parts assembled therein.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

As used herein, "forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner. "Fire control group" and "trigger assembly" or "trigger mechanism" and the like are interchangeable terms. "Trigger member" refers to the specific part that includes a blade actuated by the user to release the sear.

The illustrated embodiments herein are configured for an AR-pattern lower receiver, but the invention is not limited to this platform and may be adapted to other firearm platforms or patterns as desired. The exact design or features of the fire control parts are not critical to the invention. The trigger mechanism shown in the illustrated embodiment is a single-stage design, but the tool and method can be adapted for other trigger types or designs. After installation, the fire control group operates like a "loose component" type of trigger mechanism and no housing, jig part, or tool part remains in the firearm.

Referring first to FIG. 1, therein is shown a fire control group installation tool or unit 10, according to one or more embodiments of the present disclosure. The fire control group installation tool 10 (hereinafter, the tool 10) is utilizable for installing a fire control group 11 in a lower receiver 58. FIG. 1 depicts the fire control group 11 when assembled in the tool 10, and the lower receiver 58 includes hammer and trigger pin-receiving openings 54, 56 and is shown at least in FIGS. 4-7. The fire control group 11 depicted in the figures is a typical AR-pattern fire control group that includes a trigger member 20, a trigger spring 22, a disconnector 24, a disconnector spring 26, a hammer 28, and a hammer spring 30, which may be collectively referred to as the fire control parts or components. A (first) pin receiving opening 46 is formed or provided in the trigger member 20 and the disconnector 24, and a (second) pin receiving opening 48 is formed or provided in the hammer 28. The illustrated trigger blade design utilized in the trigger member 20 is registered trade dress of CMC Triggers Corp., of Fort Worth, Texas.

Figure 2:
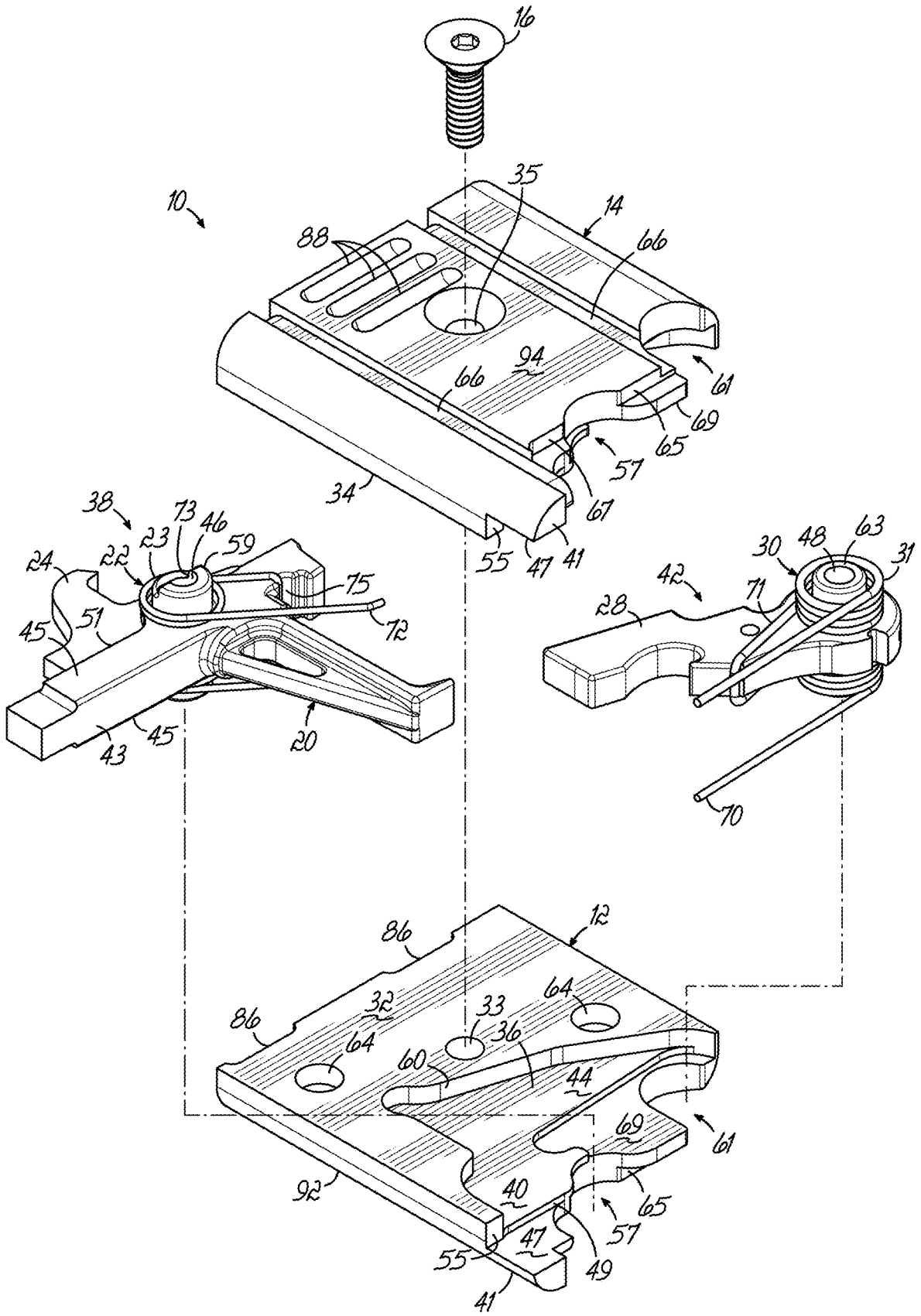
FIG. 2 is an isometric exploded view thereof showing the tools parts and trigger/hammer component groups.
Figure 3:
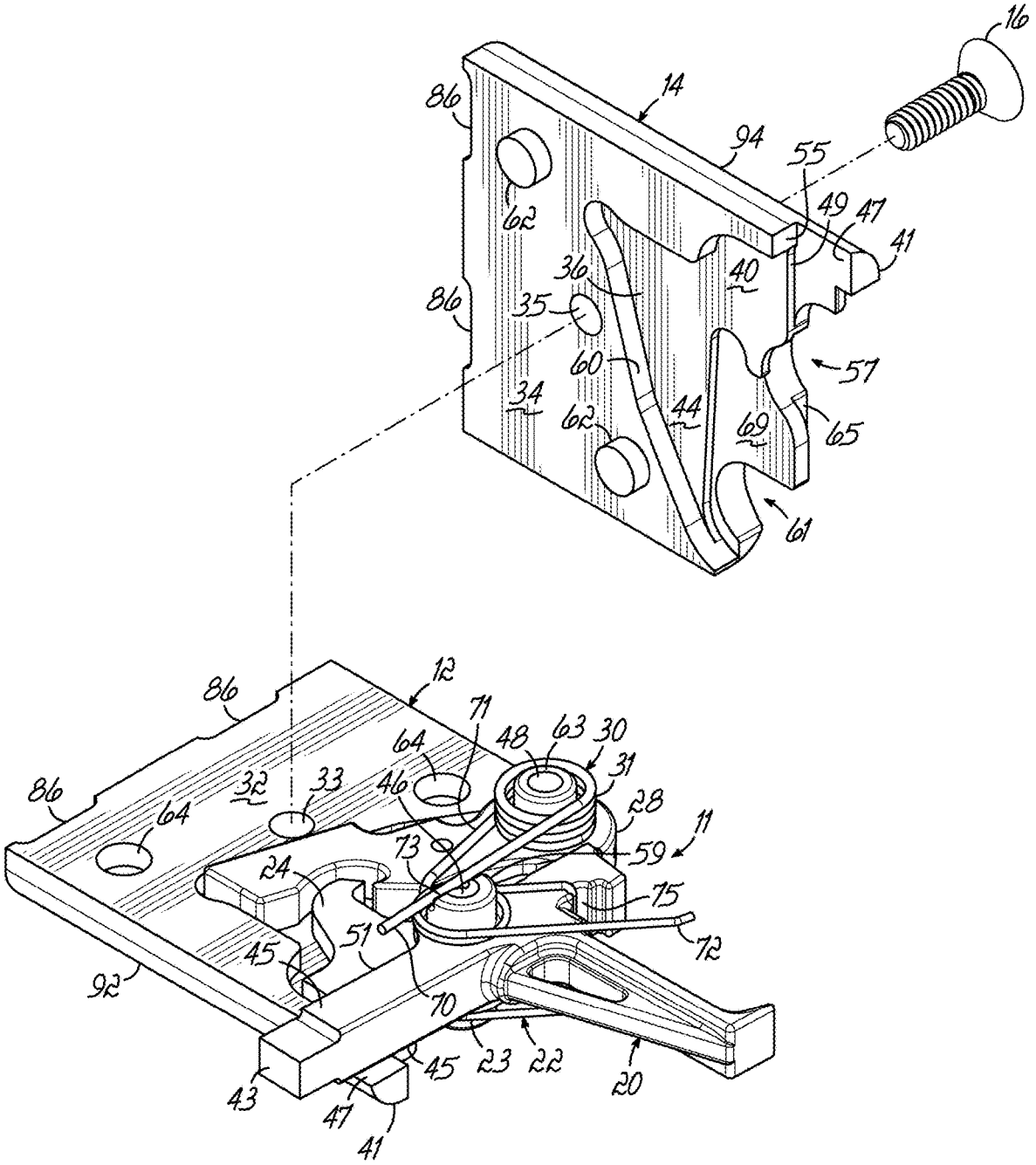
FIG. 3 is a similar view showing the trigger/hammer component groups partially assembled in the device.

Referring also to FIGS. 2 and 3, the tool 10 includes first and second tool sides or halves 12, 14, an assembly fastener 16, and flexible ties 18. The assembly fastener 16 holds the sides 12 and 14 together, and the flexible ties 18 are utilizable for temporarily holding/securing the fire control parts of the fire control group 11 in a preloaded state/condition with respect to the tool 10 (i.e., relative to the sides 12 and 14). For example, the flexible ties 18 temporarily retain the fire control parts in their preloaded state/condition and in their specific orientations relative to the first and second sides 12, 14 needed for installation within the lower receiver 58, until they are installed in the lower receiver 58 and the tool 10 is extracted or withdrawn from the lower receiver 58, as described below. The fastener 16 is optional, and the sides 12 and 14 could be held together via other means, such as via the flexible fasteners 18.

The first and second sides 12, 14 (collectively, the sides 12 and 14) are configured to fit or mate together in alignment. The sides 12, 14 do not have to each be exactly "half" of the tool 10, although in the illustrated embodiment they meet generally along a laterally central plane of the tool 10. The first and second sides 12, 14 of the tool 10 can be made of any suitable material, including metal or polymer, the parts 12, 14, and can be machined or milled, made by additive manufacturing (3D printing), or can be cast/molded.

The first side 12 includes an internal surface 32 and an external surface 92 that is opposite the internal surface 32, and the second side 14 includes an internal surface 34 and an external surface 94 that is opposite the internal surface 34. The first and second sends 12 and 14 included aligned openings 33 and 35 for receiving the assembly fastener 16. The opening 33 of the first side 12 extends through the first side 12, between the inner and outer surfaces 32, 92, and opening 35 of the second side 14 extends through the second side 14, between the inner and outer surfaces 34, 94. When the sides 12 and 14 are assembled together, with the inner surfaces 32 and 34 in contact with each other, the openings 33 and 35 are aligned with each other and the assembly fastener may be inserted through the aligned openings 33 and 35 to retain or hold the sides 12 and 14 together. Thus, the first and second sides 12 and 14 are held together via the assembly fastener 16 that extends through the aligned openings 33 and 35.

As best shown in FIGS. 2-3, a recess 36 is formed in the internal surface 32, 34 of each of the sides 12, 14. The recesses 36 have boundary walls 60 which define the shape and extent of the recesses 36. As shown, the recess 36 in each of the sides 12, 14 is shaped to receive and hold at least a portion of the components of the fire control group 11 or sets thereof. For example, the trigger member 20, the disconnector 24, the disconnector spring 26, and the trigger spring 22 can be assembled as a "set" 38 (i.e., the trigger set 38) and at least partially received by a first portion 40 of the guide recess 36 formed in each of the internal surfaces 32 and 34. Because the first set 38 includes the trigger components/parts (i.e., the trigger member 20, the disconnector 24, the disconnector spring 26, and the trigger spring 22), the set 38 is sometimes referred to as the set of trigger components or parts. Likewise, the hammer 28 and the hammer spring 30 can be assembled as a second "set" 42 of parts/components (i.e., the hammer set 42) and received by a second portion 44 of the guide recess 36 formed in each of the internal surfaces 32 and 34. Because the second set 42 includes the hammer components/parts (i.e., the hammer 28 and the hammer spring 30), the set 42 is sometimes referred to as the set of hammer components or parts Thus, the recess 36 formed in the internal surface 32 of the first side 12 includes first and second portions 40 and 44 for receiving the trigger set 38 and the hammer set 42, respectively; and, similarly, the recess 36 formed in the internal surface 34 of the second side 14 includes first and second portions 40 and 44 for receiving the trigger set 38 and the hammer set 42, respectively. In the illustrated embodiment, the recesses 36 of the first and second sides 12 and 14 are mirror images of each other. Thus, when the first and second sides 12 and 14 are assembled together, with the inner faces 32 and 34 thereof facing each other, the recesses 36 will be in full alignment with each other. Stated differently, when the sides 12 and 14 are assembled together, the boundary walls 60 of the recess 36 in the first side 12 will be aligned with the boundary walls 60 of the recess 36 of the second side 14.

As shown best in FIGS. 2-3, the disconnector 24 will be arranged in the first portion 40 of each recess 36, and the sides 12, 14 each include a downwardly extending leg 41 between which a tail 43 of the trigger 20 will positioned when the fire control group 11 is assembled in the tool 10. In particular, sidewalls 45 of the trigger 20 will abut and contact inner surfaces 47 of the legs 41. Further, the inner surface 47 of each of the legs 41 is offset outward (toward its respective exterior side 92 or 94) relative to the inner surface of the first portion 40 of the recess 36 thereof, such that a lower ledge 49 is defined between the inner surface of the first portion 40 and the inner surface 47 of the leg 41. When the trigger 20 is assembled in the tool 10, the legs 41 surround the sidewalls 45 of the tail 43 of the trigger 20, with a first sidewall 45 contacting the inner surface 47 of the leg 41 of the first side 12, with a second (opposite) sidewall 45 of the trigger 20 contacting the inner surface 47 of the leg 41 of the second side 14, and with an upper edge 51 of the trigger 20 contacting the ledges 49 of the first and second sides 12 and 14. Thus, when the sides 12 and 14 are assembled together, a channel 53 is defined between the surfaces 47 of the first and second legs 41 through which the tail 43 may extend when the trigger 20 is assembled in the tool 10.

Also, when the sides 12 and 14 are assembled together, the tool 10 includes a lower trigger facing surface that contacts or abuts the upper edge 51 of the tail 43 of the trigger 20, with a portion of the lower trigger facing surface being defined on each of the sides 12 and 14. As shown, each of the sides 12 and 14 each includes a lower trigger facing surface portion 55 that is inward or interior of the leg 41 and that joins and is continuous with and co-planar with the surface of its respective ledge 49, such that, when the sides 12 and 14 are assembled together, the lower trigger facing surface portions 55 together define the relatively wider lower trigger facing surface of the tool 10 that joins and is coplanar with the ledges 49. Thus, the leges 49 and lower trigger facing surface of the sides 12 and 14 contact the upper edge 51 of the trigger 20 when the fire control group 11 is arranged in the tool 10.

The first and second sides 12 and 14 also include a curved edge 57 that extends from, and is continuous with, the surfaces of its respective lower trigger facing surface portion 55 and ledge 49. The trigger spring 22 includes coils 23 that are arranged (or wrapped) around a boss 59 of the trigger 20 through which the pin receiving opening 46 extends. The curved edge 57 has curvature and dimensions to accommodate and receive the coils 23 and the trigger boss 59 when the tail 43 extends through the channel 53 defined between the legs 41 of the sides 12, 14, with the upper edge 51 of the trigger 20 abutting the surfaces of the respective lower trigger facing surface portions 55 and ledges 49.

In addition, the first and second sides 12 and 10 also each include a curved edge 61 for receiving a portion of the hammer spring 30 arranged on the hammer 28. The hammer spring 30 includes coils 31 that are arranged (or wrapped) around a boss 63 of the hammer 28 through which the pin receiving opening 48 extends. The curved edge 61 has curvature and dimensions to accommodate and receive the coils 31 and the hammer boss 63. Further, the first and second sides 12 and 14 each include lower edges 65 and 67 that have surfaces which are substantially co-planar with each other. The lower edges 65 of each of the sides 12 and 14 extend between the curved edges 57 and 61 of thereof, and the lower edge 67 of each of the side 12 and 14 extends between the curved edge 57 and the leg 41 thereof.

The spring 30 includes legs 70 that extend from the coil 31 and that, when installed in the firearm, will abut an upper facing ledge 73 formed in the trigger boss 59, and the spring 30 further includes a portion 71 opposite the legs 70 that is configured to at least partially surround a portion of the hammer 28 and impart biasing force on the hammer 28. When the fire control group 11 is arranged and retained in the tool 10, the spring 30 will be in a preloaded state or condition with the legs 70 thereof abutting and exerting spring force on the upper ledge 73 of the trigger boss 59, and the legs 70 will also extend along and next to the lower edges 65 and 67 of the sides 12 and 14, such that the lower edges 65 and 67 form relief spaces for the legs 70 to extend in the appropriate orientation for installation in the lower receiver 58. Further, the second portion 44 of the recess 36 includes an offset or recessed portion 69, that is further offset or recessed towards the exterior side (92 or 94) as compared to the rest of the recess 36 thereof, and the offset or recessed portion 69 provides the additional space or clearance to accommodate the hammer portion 71 of the spring 30 when assembled.

As shown in FIG. 1, when the first and second sides 12 and 14 are assembled together, with the inner surfaces 32 and 34 in contact or abutting each other, the recesses 36 of the first and second sides 12 and 14 cooperate with each other to define a cavity 15, within which at least a portion of at least some of the fire control parts of the fire control group 11 may be arranged. As mentioned, the portion of the cavity 15 defined by the offset or recessed portions 69 will be relatively wider than the remainder of the cavity 15 to accommodate the spring 30 and, in particular, to accommodate the hammer portion 71 of the spring 30.

The cavity 15 includes an opening 17 at a bottom end of the tool 10 through at least part of the fire control group 11 may be withdrawn unobstructed by the sides 12 and 14. Thus, the opening 17 may be referred to as an open bottom or a bottom opening. As detailed below, the fire control group 11 may be withdrawn or slid out of the cavity 15, through the opening 17 and unobstructed by the sides 12 and 14, when assembling the fire control group 11 in the lower receiver 58. When the tool 10 is assembled, with the sides 12 and 14 in contact with each other as shown at least in FIG. 1, the tool 10 includes a closed upper end and an open bottom end, wherein the open bottom end is formed via the opening 17. In the illustrated example, when the fire control parts of the fire control group 11 are assembled in the cavity 15, the disconnector 24 is arranged in the portion of the cavity 15 defined by first portions 40 of the recesses 36 of the first and second side 12 and 14 (as shown in FIGS. 2-3), the hammer 28 is arranged in the portion of the cavity 15 defined by second portions 42 of the recesses 36 of the first and second side 12 and 14, with the hammer portion 71 of the spring 30 arranged in the wider portion of the cavity 15 defined by the offset or recessed portions 69 (as shown in FIGS. 2-3), and the trigger 20 will be positioned outside of the cavity 15 and beneath the cavity 15 and the opening 17 thereof. In particular, the trigger 20 will be positioned beneath the curved edges 57, 61 and the lower edges 65, 67 of the sides 12 and 14 when the fire control group 11 is assembled in the tool 10.

The shape and configuration of each of the recesses 36 (and thus the shape and configuration of the larger cavity 15 defined by the recesses 36 when the sides 12, 14 are aligned and assembled together) and the positioning of the curved edges 57, 61 at the lower end of the sides 12, 14 positions the trigger set 38 and the hammer set 42 so that the pin-receiving openings 46, 48 (of the trigger and disconnector 20, 24 and the hammer 28, respectively) are aligned to correspond with placement of the hammer and trigger pin-receiving openings 54, 56 of the receiver 58. The boundary walls 60 of the recess 36 hold the fire control parts 20, 22, 24, 26, 28, 30 (or sets 38, 42) in place as the second tool side 14 is placed on the first tool side 12. For example, the fire control parts 20, 22, 24, 26, 28, and 30 may be arranged on the first side 12 with at least some of the fire control parts being placed in the recess 36 of the first side 12 (as described herein), and then the second side 14 may be placed on the first side 12 to cover the first side 12 and envelope (at least part of) the fire control group 11, with the recess 36 of the second side 14 receiving at least some of the fire control parts 20, 22, 24, 26, 28, and 30. The exact shape of the recess 36 and/or boundary walls 60 is not limitive of the inventive concept, but rather the exact shape of the recess 36 and/or boundary walls 60 may be configured to fit edges and surfaces of whatever fire control mechanism design is being used with the tool 10, whether mil-spec or special. Thus, the particular geometry of the recesses 36 and the overall cavity 15 may depend on the geometry of the particular fire control group to be received therein.

Either or both sides 12, 14 may include one or more alignment keys 62 projecting from the inner surface 34 and configured to fit into key sockets 64 formed in the opposite side inner surface 32 to keep the tool halves 12, 14 in alignment. The fastener 16 may be a screw, bolt, or the like, and the fastener 16 may be used to removably secure the sides 12, 14 to each other, if desired.

Finally, the flexible ties 18 are wrapped vertically around the tool parts 12, 14 to complete the unit 10. The ties 18 lie in vertical channels 66 on the exterior surfaces 92 and 94 of the sides 12, 14 and pass under the trigger and hammer sets 38, 42, binding the legs 70, 72 of the hammer spring 30 and trigger spring 22 in their preloaded condition/state and in place relative to the sides 12, 14. In the illustrate embodiments, the flexible ties 18 include a first flexible tie 18 and a second flexible tie 18. Here, the first flexible tie 18 wraps or extends underneath the tail 43 of the trigger member 20 to retain and secure the tail 43 within the channel 53 defined between downwardly extending legs 41 of the sides 12 and 14 and against the lower facing trigger portions 55. Also in this embodiment, the second of the flexible ties 18 wraps/extends underneath a nose 75 of the trigger member 20 and the legs 72 of the trigger spring 22, thereby securing the upper edge 51 of the nose 74 portion of the trigger member 20 in relation to the sides 12 and 14 and further maintaining the trigger spring 22 in its preloaded state/condition. As shown at least in FIG. 3, the disconnector 24 and the hammer 28 are in contact with and abut the boundary walls 60 of the recess 36, and the trigger set 38 is positioned beneath the hammer set 42 such that the trigger set 38 obstructs the hammer set 42 from falling out of the bottom opening 17. In this manner, both of the flexible ties 18 together hold and maintain position of the trigger member 20 and the disconnector 24 (and the trigger set 38) with respect to the sides 12 and 14, such that the trigger set 38 abuts and contacts the hammer set 42, and thereby presses against the hammer set 42 to maintain the hammer 28 at least partially within the cavity 15 and between the sides 12 and 14, in opposition to the legs 70 of the hammer spring 30 acting on the upper facing ledge 73 of the trigger boss 59. Thus, when the fire control group 11 is attached to the tool 10 via the flexible ties 18, the fire control group 11 is in its preloaded state/condition as both the trigger spring 22 and the hammer spring 30 are preloaded or under tension.

In embodiments, the flexible ties 18 include a flexible body portion 83, a releasable fastening mechanism 87 at one end of the body portion 83, and a free end 89 at the opposite end of the body portion 83, wherein the releasable fastening mechanism 87 is operable to receives the free end 89 (e.g., the free end 89 may be slide through the releasable fastening mechanism 87) and then the free end 89 may be pulled through the releasable fastening mechanism 87, with the releasable fastening mechanism 87 catches or holds the flexible body portion 83 and inhibits the flexible body portion 83 from backing out therefrom, to thereby tighten the flexible body portion 83 around the sides 12 and 14. Portions of the flexible body portion 83 extending past the mechanism 87 that are not under tension to hold the sides 12 and 14 together may be referred to as the free ends 89 of the flexible ties 18 and may be trimmed/cut off to thereby shorten the amount of flexible body portion 83 extending past the mechanism 87. Thus, the releasable fastening mechanism 87 essentially functions to selectively fasten the ends 89 of the flexible ties 18 and thereby tighten the flexible ties 18 around the side 12 and 14.

Figure 6:
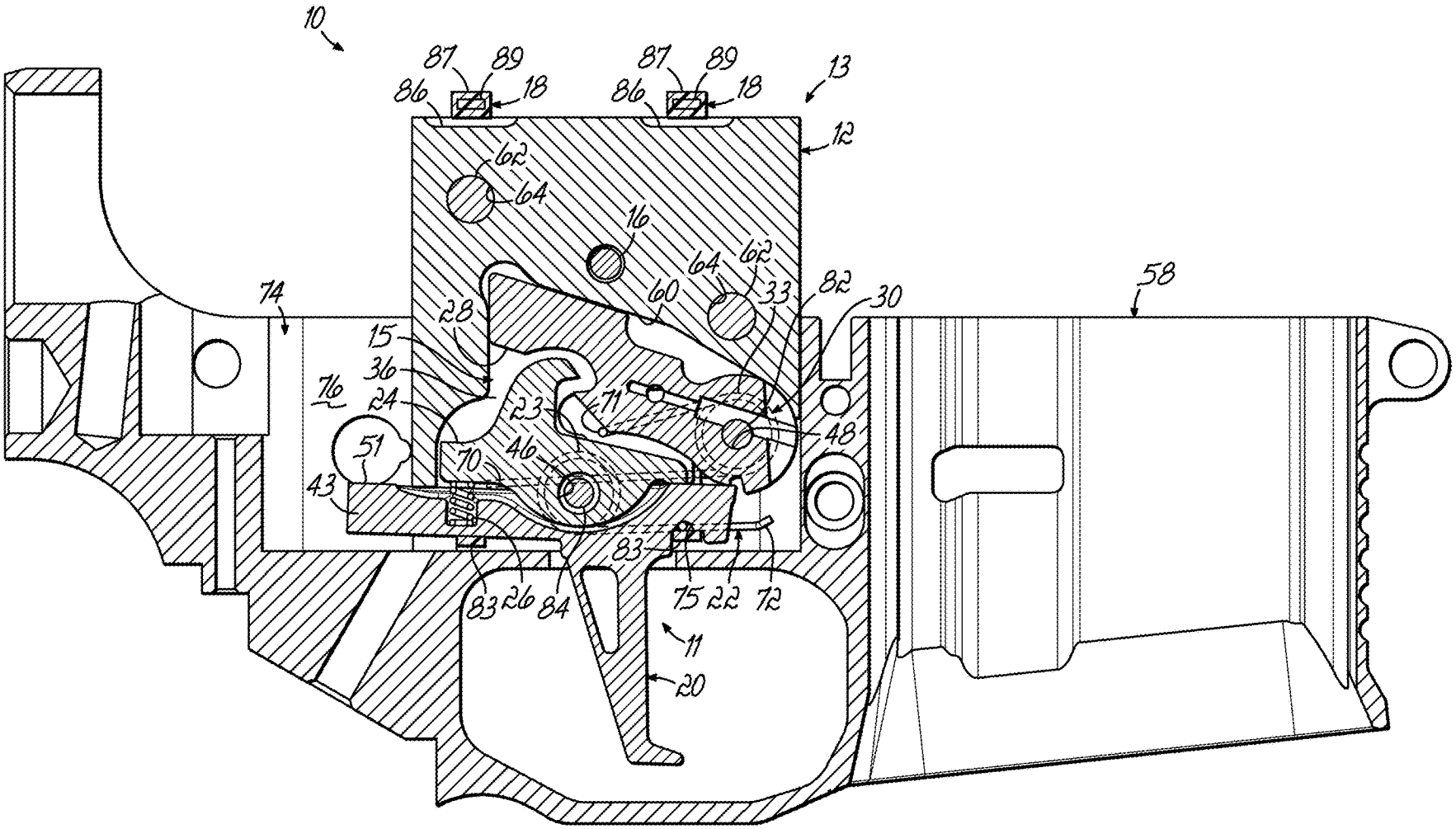
FIG. 6 is a side sectional view taken substantially along line 6-6 of FIG. 5.

In the illustrated embodiment, the flexible ties 18 are polymer ties and the releasable fastening mechanism 87 is a ratchet and pawl connector mechanism, commonly known as wire ties or "zip ties." These are widely available and inexpensive, but other forms of a flexible strap or wire could be used as well. Thus, the ties 18 may be any suitable type of flexible tie, which may be made from a polymer material, such as nylon or polypropylene or similar material, that is at a cost point that would lend itself to being disposable (i.e., consumable) and easily cut via a common cutting element or tool. As can be appreciated, the assembled tool sides 12, 14 hold the trigger and hammer sets 38, 42 in place, but provide or define an "open bottom" in the form of the opening 17. The ties 18 temporarily secure the fire control group 11 relative to the sides 12, 14 of the tool 10 and temporarily retain the fire control parts within the cavity 15 of the tool 10 or just below the cavity 15, and thereby allow the tool 10 to be manipulated unitarily in any orientation without the fire control parts 20, 22, 24, 26, 28, 30 becoming dislodged or discharged (i.e., moved from the preloaded state/condition to an unloaded state/condition) by impact or gravity. For example, when assembling the fire control group 11 in or to the tool 10, the hammer 22 is placed in the second portion 44 of the recess 36 of the first side 12, with the hammer boss 63 abutting the curved edge 61 of the first side 12, and then the disconnector 24 is placed in the first portion 42 of the recess 36 and the tail 43 of the trigger member 20 is placed on the inner surface 47 of the leg 41 of the first side 12, with the legs 70 of the hammer spring 30 abutting and in contact with the ledge 73 of the trigger boss 59, such that the legs 70 of the hammer spring 30 are urging the trigger set 38 away from the hammer set 42, and then the second side 14 is assembled on the first side 12 (and connected to the first side 12, for example, via the fastener 16) such that the second side 14 envelopes and covers or surrounds the fire control group 11 in the same manner as does first side 12; and then the flexible ties 18 are wrapped around the sides 12 and 14 and the fire control group 11, with the flexible ties 18 extending underneath the tail 43 and the nose 75 of the trigger member 20. By wrapping the flexible ties 18 underneath the trigger member 20 in this manner, the flexible ties 18 are able to urge the trigger set 38 upward towards the hammer group 42 and towards the upper end of the tool 10, in opposition to the spring force of the hammer spring 30 that is acting downward on trigger boss 59, such that the hammer spring 30 is in its preloaded state/condition. Also, by wrapping the flexible ties 18 underneath the trigger member 20 in this manner, the flexible ties 18 pull the legs 72 upward toward the hammer 28 and the cavity 15, such that the flexible ties 18 hold and position the legs 72 of the trigger spring 22 in a substantially horizontal orientation, in opposition to any spring force of the trigger spring 22 urging the legs 72 downward. As will be appreciated, when the trigger member 20 and the trigger spring 22 are installed in a fire control pocket 74 of the lower receiver 58, the legs 72 of the trigger spring 22 will be generally oriented in such horizontal orientation, as shown in FIG. 6. However, by removing the flexible ties 18 from the tool 10, e.g., by cutting them and pulling them out of the fire control pocket 74, the legs 72 of the trigger spring 22 will no longer be constrained by the flexible ties 18, thereby allowing the legs 72 of the trigger spring 22 to deflect or spring downward under their spring force and abut or contact a bottom surface in fire control pocket 74 of the lower receiver 58.

Figure 4:
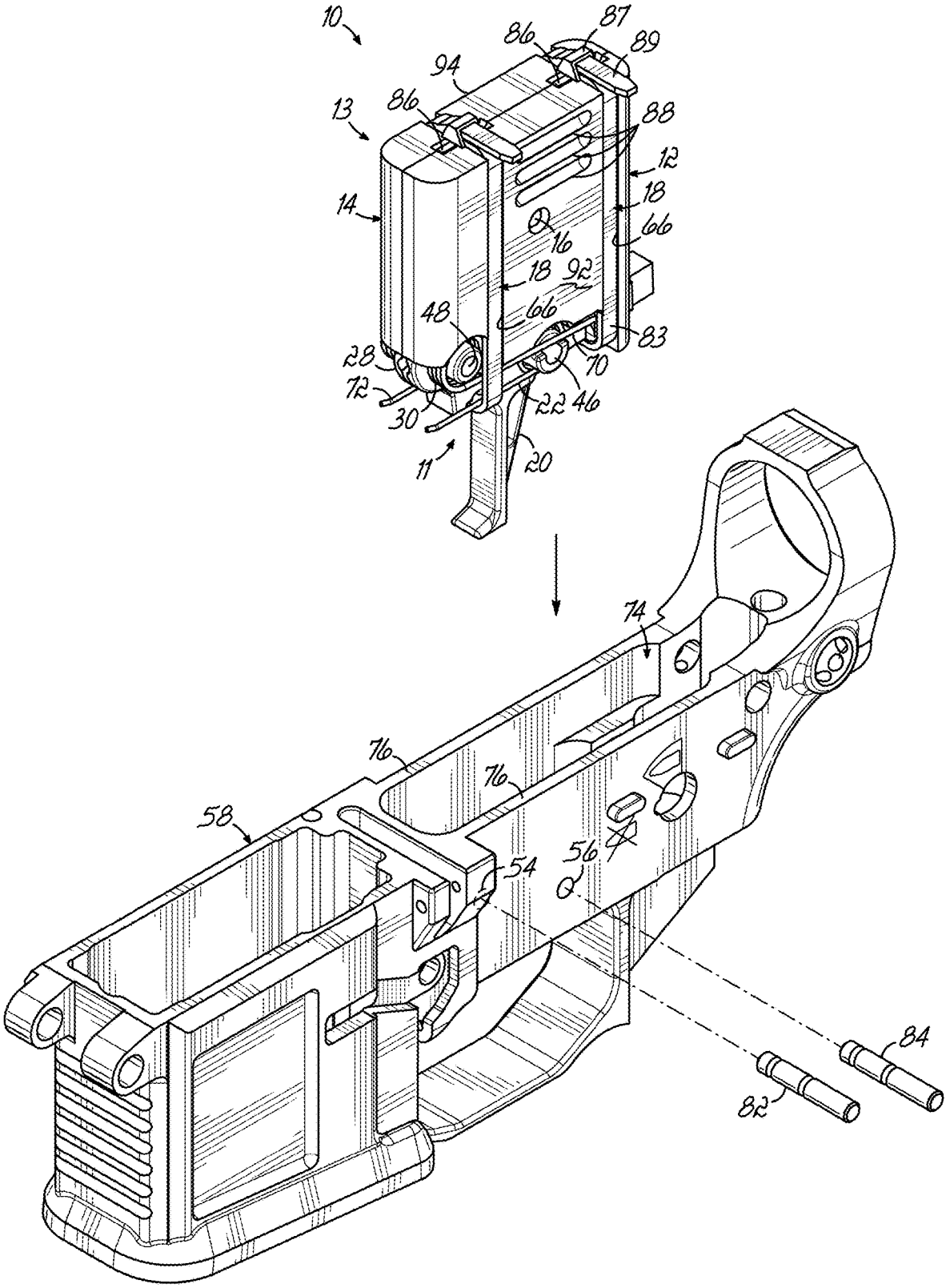
FIG. 4 is an isometric view showing the assembly of the installation device into an AR-pattern lower receiver.

Referring now to FIGS. 4-7, and first to FIG. 4, therein shown a typical and well-known AR-pattern lower receiver 58 that includes the fire control pocket 74 defined therein. As shown, the fire control pocket 74 is open at the top, but otherwise substantially surrounded by the lower receiver sidewalls 76 and a bottom wall of the receiver 58. The lower receiver sidewalls 76 have opposite pairs of openings 54, 56 configured to receive typical hammer and trigger pivot or axle pins 82, 84.

Figure 5:
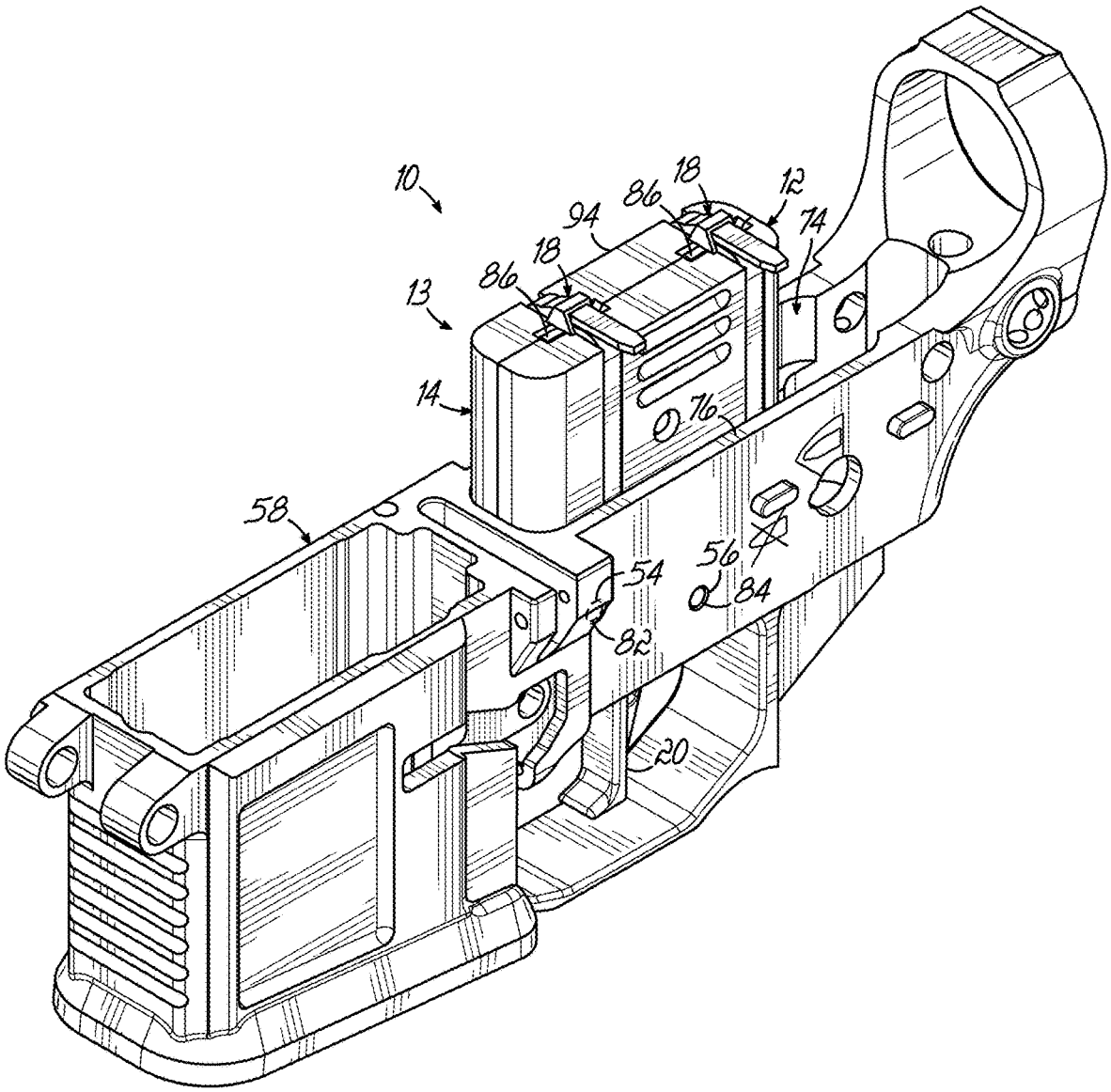
FIG. 5 is a similar view showing the unit inserted into the pocket of the lower receiver and insertion of the hammer/trigger pins.

Referring now specifically to FIGS. 5 and 6, the tool 10 is dimensioned so that the fire control group 11 is assembled on the tool 10, the tool 10 with the fire control group 11 assembled thereto will fit between the sidewalls 76 of the fire control pocket 74; and, when the tool 10 with the fire control group 11 assembled thereto is inserted into the fire control pocket 74, the tool 10 is able to position the pin receiving opening 48 of the hammer 28 and the pin receiving opening 46 of the trigger member 20 in alignment to receive the hammer and trigger pins 82, 84 inserted through the openings 54, 56 in the receiver side walls 76. The hammer and trigger pins 82, 84 illustrated are of standard design with well-known annular grooves to engage spring legs 70 and 72 as detents. If desired, nonrotating pins (not shown), which are also well known, can be used.

Figure 7:
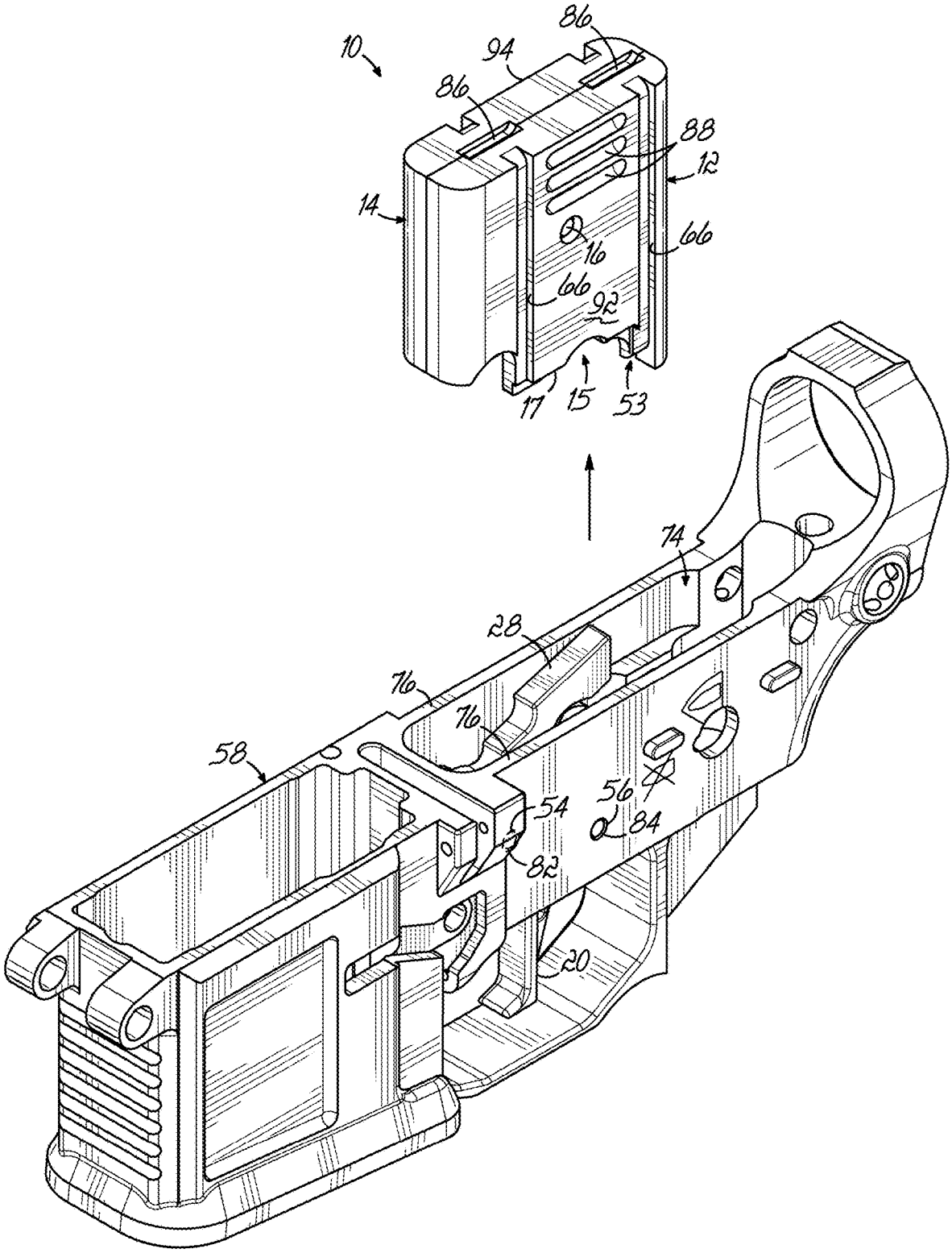
FIG. 7 is a similar view showing removal of the tool after installation of the trigger components into the lower receiver.

Referring now specifically to FIG. 7, after insertion of the hammer pin 82 and trigger pin 84, the ties 18 can be cut, unfastened, or otherwise detached and then flexibly pulled out from under the installed fire control group components 20, 22, 24, 26, 28, 30. Undercuts 86 (shown in FIGS. 8 and 9) can be provided in the top end of the tool sides 12, 14, opposite the opening 17, to provide access to an underside of the ties 18 and thereby facilitate easy cutting of the ties 18 with a common cutting tool (not shown). Or ties 18 with a releasable fastening mechanism or means can be used. If desired, grip recesses 88 can be provided on the outer/outside surfaces 92 and 94 of the sides 12, 14 to facilitate removal of the tool 10. The "open bottom" aspect of the tool allows it to be removed by pulling it upward, out of the receiver pocket 74 after the ties 18 have been released, either before or after the ties 18 have been removed. The safety selector and other lower receiver parts (not shown) can be assembled in the ordinary manner.

Thus, disclosed herein is a method of installing the fire control group 11 in the fire control pocket 74 of the lower receiver 58. The method thus includes assembling the fire control group 11 on the tool 10, wherein the tool 10 is configured as detailed above. This step of the method may include arranging one or more components of the fire control group 11 on the first side 12 and then placing the second side 14 on the first side 12, so that at least some of the fire control group 11 components are surrounded or enveloped by the second side 14 and thus contained in the cavity 15 defined between the first and second side 12 and 14, and then wrapping the flexible ties 18 around the sides 12 and 14; and the method may further include securing the first and second sides together, for example, by inserting the fastener 16 through the aligned openings 33 and 35 in the sides 12 and 14; and the fastener 16 may be utilized to hold the sides 12 and 14 together before or after installing the flexible ties 18. The method may then include inserting the tool 10 with the fire control group 11 assembled thereto into the fire control pocket 74, and then aligning the pin receiving opening 46 of the trigger components 38 (i.e., of the trigger member 20) with the first pair of aligned openings 56 in the sidewalls 76 and aligning the pin receiving opening 48 of the hammer components 42 (i.e., of the hammer 28) with the second pair of aligned openings 54 in the sidewalls 76. The method then includes inserting the trigger pin 84 through the first pair of aligned openings 56 and the pin receiving opening 46 in the trigger components 38 (i.e., in the trigger member 20), and includes inserting the hammer pin 82 through the second pair of aligned openings 54 and the pin receiving opening 48 in the hammer components 42 (i.e., in the hammer 28). Thereafter, the method includes unfastening the flexible ties 18, for example, by cutting the flexible ties 18 or engaging the releasable fastening mechanism of the flexible ties to thereby separate the ends of the flexible ties 18. Finally, the method may include removing the tool 10 from the fire control pocket 74 while leaving the fire control group 11 installed within the fire control pocket 74. The method may also include removing the flexible ties 18 from underneath the fire control group 11 prior to removing the tool 10 from the fire control pocket 74. The step of removing the tool 10 may include sliding the tool 10 upward, over and relative to, the fire control group 11, as shown by the arrow in FIG. 7 which depicts the tool 10 being slid upward, out and away from, the fire control pocket 74.

The invention also includes the above-described method of installing/deinstalling a fire control group using the tool.

Figure 8:
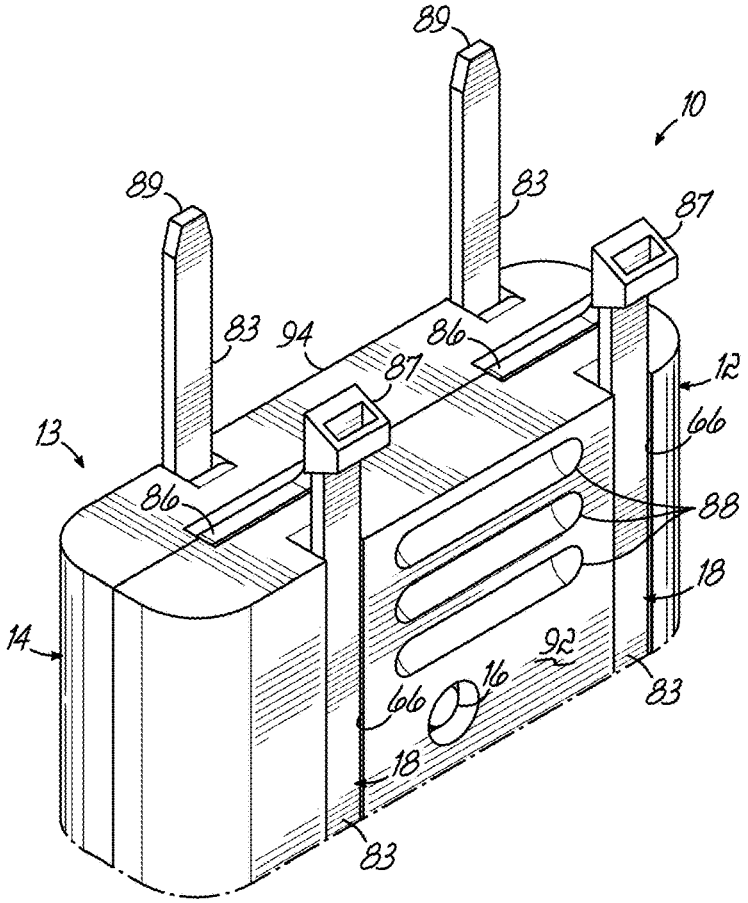
FIG. 8 is an enlarged partial isometric view of the top portion of the device with ties unfastened.
Figure 9:
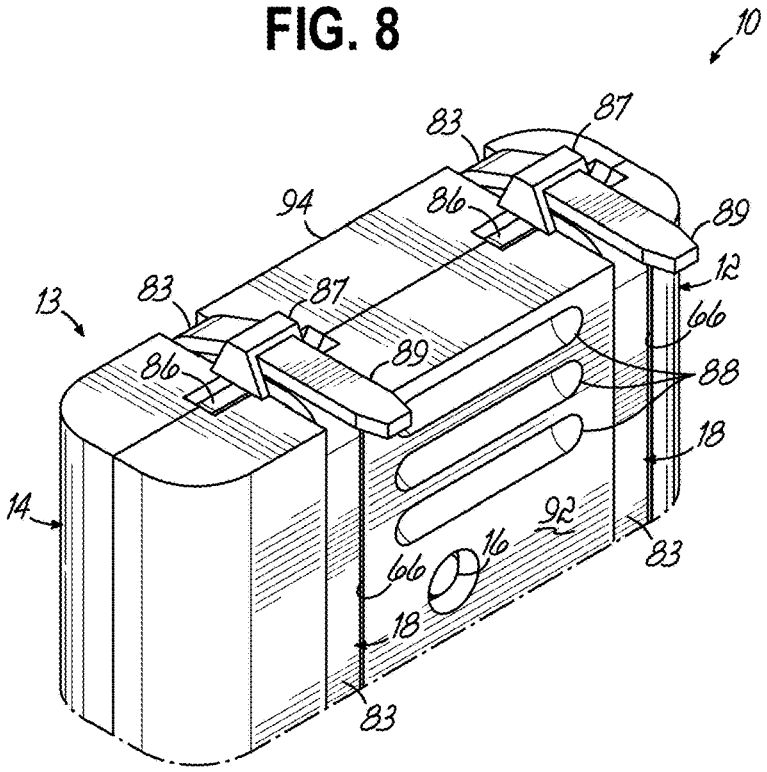
FIG. 9 is a similar view showing the ties fastened.

The tool 12, 14 can also be used for removal of the fire control parts 20, 22, 24, 26, 28, 30 as a group. With the hammer 28 cocked, flexible ties 18 can then be inserted or threaded under the trigger member 20. The fastened-together tool sides 12, 14 can be inserted into the receiver pocket 74 over the installed fire control parts 20, 22, 24, 26, 28, 30; and then ends 89 of the flexible ties 18 can be fastened together, as depicted in FIGS. 8 and 9, such that the flexible ties 18 vertically extend and wrap around the sides 12 and 14. A punch can be used to drive the hammer and trigger pins 82, 84 out of placement, then allowing the fire control parts 20, 22, 24, 26, 28, 30 to be removed as a group along with the tool as a unit 10.

The presently disclosed tool 10 may be sold separately, without any portion of the fire control group 11, as just the installation/deinstallation tool 10, or any one or more components of the fire control group 11 (e.g., the fire control parts 20, 22, 24, 26, 28, 30) may be pre-assembled in the tool 10 with such components and the tool 10 being sold as a kit 13 easy installation. FIG. 1 depicts and example of the kit 13, according to one or more embodiments, wherein the kit 13 includes the components 20, 22, 24, 26, 28, 30 of the fire control group 11 pre-assembled within the tool 10 as a single unit for sale. The kit 13 may be referred to as a firearm kit.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A tool for installing a fire control group in a lower receiver, the fire control group comprising a set of trigger components and a set of hammer components, the tool comprising:

a first side having an inner surface, an outer surface opposite the inner surface, and a recess defined in the inner surface, the recess having a first portion for receiving at least a portion of the trigger components and a second portion for receiving at least a portion of the hammer components;

a second side having an inner surface, an outer surface opposite the inner surface, and a recess defined in the inner surface, the recess having a first portion for receiving at least a portion of the trigger components and a second portion for receiving at least a portion of the hammer components;

wherein, when first and second sides are assembled together, the inner surfaces of the first and second side contact each other and the recesses of the first and second side cooperate with each other to define a cavity within which the set of trigger components and the set of hammer components are at least partially arranged, the cavity having a bottom opening through which the fire control group may be withdrawn unobstructed by the first and second side; and a flexible tie wrapped around the first and second sides for retaining the fire control group relative to the first and second sides in a preloaded state.

2. The tool of claim 1, wherein the first and second sides comprise a metal or a polymer.

3. The tool of claim 1, wherein the first and second sides are formed via additive manufacture, casting or molding, or machining.

4. The tool of claim 1, wherein a recessed channel is defined in the outer surfaces of the first and second sides for receiving the flexible tie.

5. The tool of claim 4, wherein the flexible tie is a pair of flexible ties and the channel is a pair of channels.

6. The tool of claim 1, wherein the flexible tie is a zip tie with a ratchet and pawl connector mechanism.

7. The tool of claim 1, wherein the first side comprises an alignment key protruding from the inner surface thereof, and the second side comprises a key socket formed in the inner surface thereof for receiving the alignment key of the first side.

8. The tool of claim 1, wherein the first and the second sides are held together via an assembly fastener that extends through aligned openings in the first and second side.

9. The tool of claim 1, wherein the set of trigger components comprises a trigger member and a disconnector, and the set of hammer components comprises a hammer, and wherein, when the fire control group is assembled in the tool, the disconnector is in the first portion of the recesses, the hammer is in the second portion of the recesses, and the trigger is beneath the cavity.

10. The tool of claim 1, wherein the first and second sides include a top end and a bottom end opposite the top end, wherein the bottom opening is formed at the bottom end, and wherein at least one undercut is formed at the top end of the first and second side to provide access to an underside of the flexible ties.

11. The tool of claim 1, further comprising grip recesses formed in the outer surfaces of the first side and/or the second side.

12. A method for installing a fire control group in a fire control pocket by sidewalls of a lower receiver, the fire control group comprising hammer components and trigger components, the method comprising:

assembling the fire control group on a fire control group installation tool, wherein the fire control group installation tool comprises:

a first side having an inner surface, an outer surface opposite the inner surface, and a recess defined in the inner surface, the recess having a first portion for receiving at least a portion of the trigger components and a second portion for receiving at least a portion of the hammer components, a second side having an inner surface, an outer surface opposite the inner surface, and a recess defined in the inner surface, the recess having a first portion for receiving at least a portion of the trigger components and a second portion for receiving at least a portion of the hammer components, wherein, when first and second sides are assembled together, the inner surfaces of the first and second side contact each other and the recesses of the first and second side cooperate with each other to define a cavity within which the set of trigger components and the set of hammer components are at least partially arranged, the cavity having a bottom opening through which the fire control group may be withdrawn unobstructed by the first and second side, and a flexible tie wrapped around the first and second sides for retaining the fire control group relative to the first and second sides in a preloaded state;

inserting the control group installation tool with the fire control group assembled thereto into the fire control pocket;

aligning a pin receiving opening in the trigger components with a first pair of aligned openings in the sidewalls, and aligning a pin receiving opening in the hammer components with a second pair of aligned openings in the sidewalls;

inserting a trigger pin through the first pair of aligned openings and the pin receiving opening in the trigger components, and inserting a hammer pin through the second pair of aligned openings and the pin receiving opening in the hammer components;

unfastening the flexible ties; and removing the control group installation tool from the fire control pocket.

13. The method of claim 12, further comprising removing the flexible ties from underneath the fire control group prior to removing the control group installation tool from the fire control pocket.

14. The method of claim 12, wherein unfastening the flexible ties further comprises:

cutting the flexible ties or, where the flexible ties include a releasable fastening mechanism, engaging the releasable fastening mechanism.

15. The method of claim 12, wherein removing the control group installation tool from the fire control pocket further comprises sliding the control group installation tool upward, over and relative to, the fire control group.

16. The method of claim 12, wherein assembling the fire control group on the fire control group installation tool comprises:

arranging the hammer components and the trigger components on the first side; and placing the second side on the first side such that the first and second sides at least partially envelope the fire control group.

17. The method of claim 16, further comprising: securing the first and second sides together.

18. The method of claim 17, wherein securing the first and second sides together further comprises:

inserting a fastener through aligned openings in the first and second sides.

19. A kit for a firearm, comprising:

a fire control group comprising:

a set of trigger components, and a set of hammer components; and a fire control group installation tool comprising:

a first side having an inner surface, an outer surface opposite the inner surface, and a recess defined in the inner surface, the recess having a first portion for receiving at least a portion of the trigger components and a second portion for receiving at least a portion of the hammer components, a second side having an inner surface, an outer surface opposite the inner surface, and a recess defined in the inner surface, the recess having a first portion for receiving at least a portion of the trigger components and a second portion for receiving at least a portion of the hammer components, wherein, when first and second sides are assembled together, the inner surfaces of the first and second side contact each other and the recesses of the first and second side cooperate with each other to define a cavity within which the set of trigger components and the set of hammer components are at least partially arranged, the cavity having a bottom opening through which the fire control group may be withdrawn unobstructed by the first and second side, and a flexible tie wrapped around the first and second sides for retaining the fire control group relative to the first and second sides in a preloaded state.

* * * * *